US005644959A

United States Patent [19]

Howard

[11] Patent Number: 5,644,959

[45] Date of Patent: Jul. 8, 1997

[54] UNIVERSAL SOCKET WRENCH

[75] Inventor: Herman S. Howard, Hallandale, Fla.

[73] Assignee: Media Group, Stamford, Conn.

[21] Appl. No.: 653,695

[22] Filed: May 22, 1996

[51] Int. Cl.[6] ..... B25B 13/58

[52] U.S. Cl. ..... 81/185; 81/179; 81/DIG. 11

[58] Field of Search ..... 81/179, 185, DIG. 11

[56] References Cited

U.S. PATENT DOCUMENTS 5,386,749 2/1995 Kim ..... 81/185
5,460,064 10/1995 Zayat ..... 81/185

*Primary Examiner*—James G. Smith
*Attorney, Agent, or Firm*—Skadden, Arps, Slate, Meagher and Flom, LLP

[57] ABSTRACT

A universal socket wrench is provided comprising a housing having an internal chamber which is open at a first end thereof. A bundle of members having relatively large cross-sectional area-to-length ratios is supported in a slidable relationship within the chamber. The first ends of the slidable members are arranged for engagement with a fastener component. The slidable members have a chevron shape and a generally nonuniform cross-sectional area, and are arranged in sets, the outer and inner perimeter of each set having a fragmentary, asymmetrical shape. The slidable members are supported within the housing by outwardly extending flanges on the second ends of the members, which conform to and engage with inset shoulders on the chamber and on the second ends of the members. The second ends of the slidable members are biased by springs, one spring biasing each member, so that when the slidable members are displaced by contact with a fastener component, the springs tend to return the members to their original positions. The second end of the springs seat in an insert, the insert having a plurality of bores therethrough for that purpose, and a separate, thin backing plate positioned to ensure that the springs are retained within the second end of the housing.

12 Claims, 5 Drawing Sheets

UNIVERSAL SOCKET WRENCH

FIELD OF THE INVENTION

This invention relates to socket wrenches, and more particularly to a universal socket wrench having the capability of accommodating a variety of differently sized and shaped fastener components, such as hex or square nuts and bolts, wing screws, eye bolts, thumb screws and other fasteners.

BACKGROUND OF THE INVENTION

Various attempts have been made to provide a single tool for removing fastener components having many sizes and shapes. Primarily, those attempts have involved two distinct design approaches. One approach to designing such a tool has been to utilize a socket housing forming a longitudinal chamber holding a set of symmetrically-shaped, concentrically-nested, longitudinally telescoping sockets. Patents disclosing devices of this general type include Greiner, U.S. Pat. No. 1,896,949, issued Feb. 7, 1933, Pearson, U.S. Pat. No. 1,997,948, issued Apr. 16, 1935, Svenson, U.S. Pat. No. 2,875,660, issued Mar. 3, 1959, Haber, U.S. Pat. No. 2,938,417, issued May 31, 1960, Rogers, U.S. Pat. No. 3,127,797, issued Apr. 7, 1964, Mahall, U.S. Pat. No. 3,250,158, issued May 10, 1966, Mahall, U.S. Pat. No. 3,262,338, issued Jul. 26, 1966, Svenson, U.S. Pat. No. 3,285,106, issued Nov. 15, 1966, Lynn, U.S. Pat. No. 3,298,261, issued Jan. 17, 1967, Nicastro, U.S. Pat. No. 4,489,628, issued Dec. 25, 1984, Hurst, U.S. Pat. No. 4,528,875, issued Jul. 16, 1985, Kim, U.S. Pat. No. 5,074,174, issued Dec. 24, 1991, Nogues, U.S. Pat. No. 5,157,995, issued Oct. 27, 1992, and Mathers, U.S. Pat. No. 5,163,344, issued Nov. 17, 1992.

Another approach to designing a universal tool has been to utilize a socket housing forming a longitudinal chamber having a first end and holding a bundle of pins, bars or rods of uniform shape and size with the first ends of such pins nominally proximal to the first end of the chamber. When a fastener component contacts the ends of the pins, the contacted pins are displaced away from the first end of the chamber. The pins that are not contacted by the fastener component remain in their nominal positions, surrounding the component and providing surfaces against which the fastener component can be gripped for turning. The designs following this general approach utilize cross sections that are square, circular, octagonal and triangular in shape. In some of these designs, the pins are thin enough as to engage the recessed slots of Phillips or slotted screws. Patents disclosing devices of this general type include Wiedmann, German Patent No. 315,926, issued Apr. 26, 1918, Popper, U.S. Pat. No. 3,251,251, issued May 17, 1966, Locke, U.S. Pat. No. 3,349,655, issued Oct. 31, 1967, Denney, U.S. Pat. No. 3,698,267, issued Oct. 17, 1972, Pasbrig, U.S. Pat. No. 3,858,468, issued Jan. 7, 1975, and Zayat, U.S. Pat. No. 4,887,498, issued Dec. 19, 1989.

A typical universal tool utilizing this design is described in Zayat, which discloses a bundle of over four hundred individual pins longitudinally suspended within a chamber by a plurality of side-by-side rails, and biased to a nominal position by individual springs mounted on rods connecting the pins to the rails. The pins are shown to be of a uniform circular or square cross-section. The Zayat design relies on its many relatively small pins to provide a snug fit around the component head. Due to the pins' small cross sectional areas, each pin relies on the support of the surrounding pins and the housing to prevent the pin's disfigurement or fracture. Because of the small cross-sectional area of the many pins, the '498 tool accommodates a great many shapes and sizes of components, including Phillips and slotted-screws.

With respect to the telescoping socket designs, although they are inherently structurally strong, one of their disadvantages is that relatively few sockets can be nested in a single tool before the tool becomes too large or unwieldy to use, such that the variety of fastener shapes and sizes with which the sockets are compatible is extremely limited. Additionally, any fastener component to be turned must be centered with respect to the first end of the chamber of the tool, and if a socket size compatible with that component is not available, the component cannot be turned.

Similarly, designs utilizing bundles of uniform pins or rods suffer from a number of disadvantages. For example, the uniform square and circular pin shapes suggested by Zayat, and the other similar shapes suggested by other prior art references, are not well adapted to provide the structural stability necessary to withstand the application of large amounts of torque. Additionally, the small cross-sectional area-to-length ratios of the pins renders the pins susceptible to disfigurement or fracture during use of the wrench, especially when extracting a fastener component having a head with a large cross-sectional area compared to the cross-sectional area of the housing chamber. In such a situation, the component approaches the outer perimeter of the chamber and relatively few of the pins can be used to transmit torque to the fastener head, thus decreasing their structural support and making structural failure more likely. Another disadvantage is that, similar to the complicated suspension and pin biasing systems disclosed in Zayat, the several pin-bundle references disclose pin suspension and biasing systems that are complicated, ineffective, difficult to assemble, or expensive to manufacture.

SUMMARY OF THE INVENTION

The present invention is directed to a unique embodiment of a universal socket wrench that is simple in design, easy to assemble and manufacture, easy to use and having enhanced structural stability even upon the application of large amounts of torque. The invention comprises a housing having an internal chamber which is open at a first end thereof. A bundle of slidable members is supported in a slidable relationship within the chamber, the first ends of the slidable members being nominally positioned proximal to the first end of the chamber for engagement with a variety of fastener components having different sizes and shapes. The slidable members have generally nonuniform cross-sectional areas, preferably a generally chevron shape, and cross-sectional area-to-length ratios of at least about one (1) to twenty (20), preferably one (1) to fifteen (15). They are arranged in generally concentric sets and suspended by a simple footing and shoulder suspension means, and are biased in their nominal positions by a simple spring bias system. The arrangement of the members into generally concentric sets provides the structural advantages encompassed by prior art designs utilizing nested, integral sockets, without having the limited fastener compatibility encountered by those integral socket designs. Furthermore, due to the nonuniform member sizes and chevron shape, and the concentric set arrangement of the members, many longitudinal edges and face surfaces of the members are exposed to grip the fastener heads. These features provide the structural strength and stability necessary for transmitting high torque values, and further permit an enhanced fastener head gripping capability. Additionally, this design permits the turning of fastener components without requiring that such components be centered with respect to the socket chamber.

Accordingly, it is an object of the present invention to provide a universal socket wrench capable of engaging and turning a plurality of different size fastening elements.

Another object of the present invention is to provide a universal socket wrench encompassing a plurality of slidable members having an inherently structurally strong cross-sectional shape to withstand the application to the wrench of large amounts of torque.

Yet another object of the present invention is to provide a universal socket wrench encompassing a plurality of slidable members having cross-sectional area-to-length ratios large enough to significantly enhance the ability of the members to withstand the application to the wrench of large torque values.

Still another object of the present invention is to provide, for a bundle of slidable members having generally nonuniform cross-sectional areas, an arrangement wherein those members benefit from the structural advantages of integral socket designs, yet have an enhanced ability to engage many differently sized and shaped components, and to do so without the need to center such components with respect to the wrench.

It is another object of the present invention to provide an enhanced fastener head gripping ability for a wide variety of fastener head sizes and shapes.

It is yet another object of the present invention to provide a universal socket wrench with a simple system by which to suspend the slidable members and to bias the members in their nominal positions, that is easy to assemble and inexpensive to manufacture.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
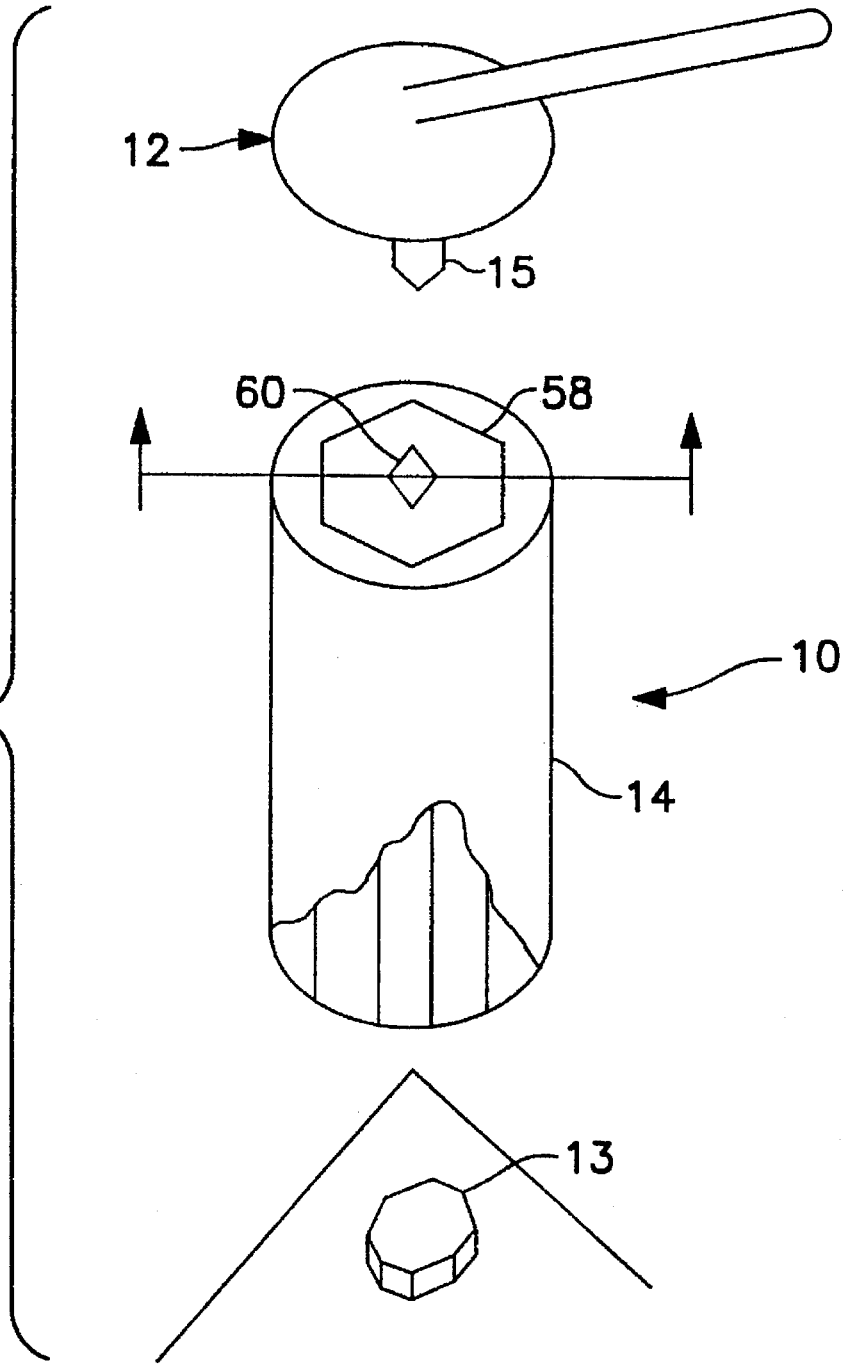
FIG. 1 is a perspective view of the instant universal socket wrench shown in connection with a drive tool and fastening component.
Figure 2:
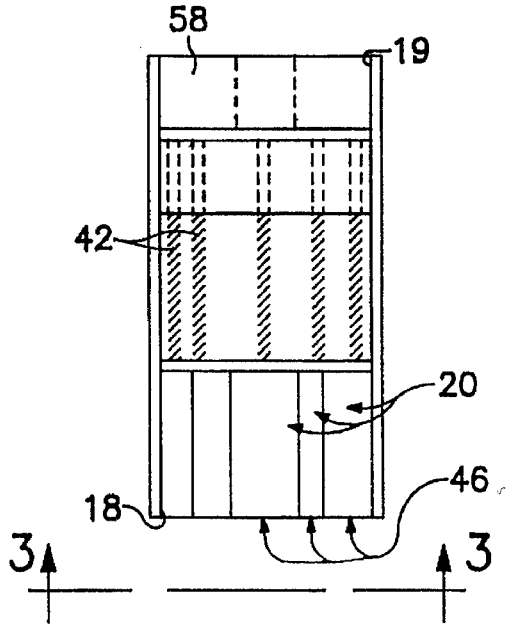
FIG. 2 is a cross-sectional view taken along line 2—2 of FIG. 1.
Figure 4:
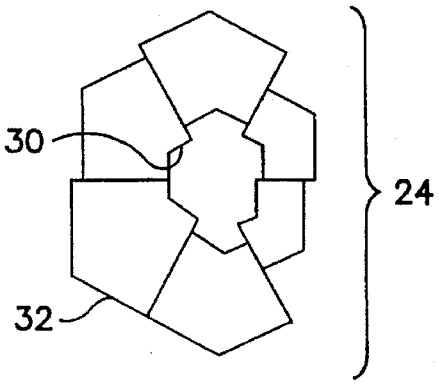
FIG. 4 is another orthographic end view taken along line 3—3 of FIG. 2, but including only the slidable members encompassed by the second set of such members.
Figure 5:
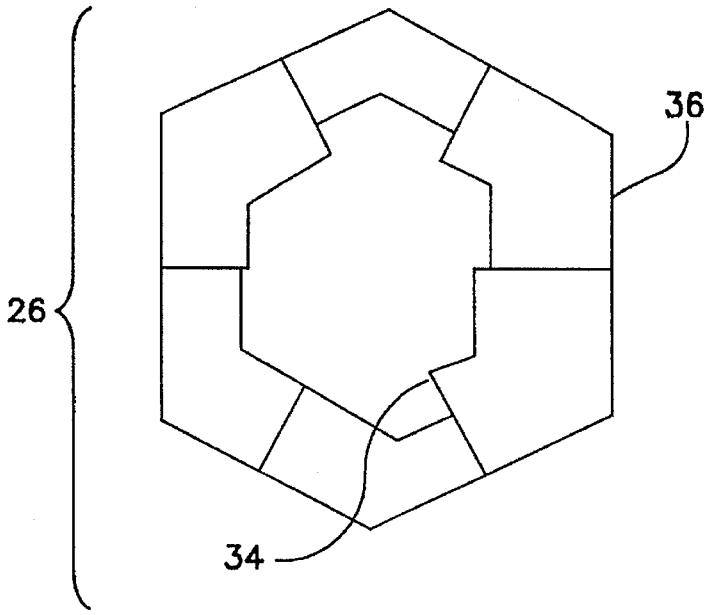
FIG. 5 is also an orthographic end view taken along line 3—3 of FIG. 2, but including only the slidable members encompassed by the third set of such members.
Figure 6:
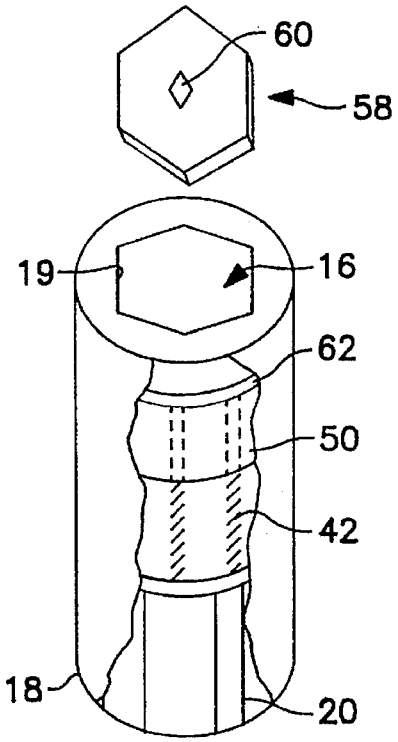
FIG. 6 is another perspective view, partially broken away and partially exploded, of the universal socket wrench.

Referring now to the drawings, a preferred embodiment of the universal socket wrench of the instant invention is generally illustrated in FIGS. 1–12. Referring to FIGS. 1, 2 and 6, the universal socket wrench 10 is positioned for operative engagement with a drive tool 12 for turning a plurality of differently sized fastener components such as hex or square nuts and bolts, wing screws, eye bolts, thumb screws and other fasteners. The drive tool 12 comprises a conventional socket driver having a square mounting lug 15 for engagement of the socket wrench 10.

Figure 3:
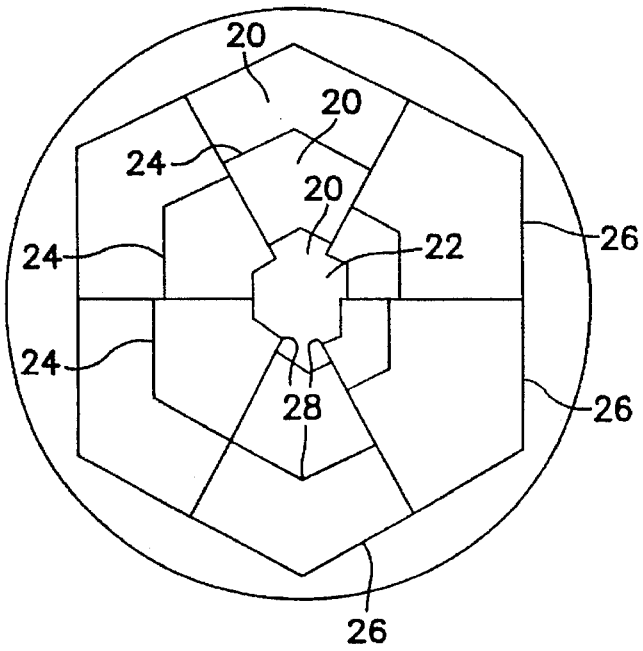
FIG. 3 is an orthographic end view taken along line 3—3 of FIG. 2.

The universal socket wrench 10 is comprised of a socket housing 14 having therein a longitudinal internal chamber generally indicated at 16. The chamber 16 is open at a first end 18 and closed at a second end 19, and in this embodiment, the cross-sectional shape of the chamber is hexagonal, as illustrated in FIGS. 1, 3, and 6. Other cross-sectional shapes, such as rectangular, square, octagonal, star-shaped, or shapes having edges or grooves may also be adapted and will be readily apparent to those skilled in the art. Referring now to FIGS. 2 and 3, the wrench further comprises a plurality of individual members generally indicated at 20 being slidably suspended longitudinally within the chamber 16. As is illustrated in FIG. 3, the slidable members 20 of this embodiment are generally nonuniform in size and cross-sectional area. The members are arranged in generally concentric sets, a center member 22 being surrounded by a second set of members generally indicated at 24, and the second set of members being surrounded by a third set of members generally indicated at 26. Although this embodiment is limited to three sets, it will be obvious to persons of skill in the art that further generally concentric sets may be incorporated by increasing the size of the chamber, or decreasing the size of the members.

The center member 22 has an irregular shape comprised of a plurality of sides, the shape and the number of sides being determined by the intersection of the second set members 24. In the embodiment illustrated, the center member 22 comprises sixteen sides, and the center member occupies completely the enclosed area formed by the second set members 24 as positioned within the chamber 16. As will be obvious to persons skilled in the art, the shape and number of sides of the center member 22 will vary, generally in conjunction with the enclosed area formed by the second set members 24. Due to the member suspension system as will be hereinafter more fully described, the center member 22 does not provide surfaces against which to grip fastener components, and therefore need not be made of a structural material such as steel. Instead, the center member 22 may be economically manufactured from plastic or similarly inexpensive materials. It is to be understood, however, that alternative member suspension means may be employed, such that the center member 22 would be available to grip fastener elements, and it would then be necessary to manufacture the center member 22 from a material capable of bearing the loads involved in the use of the wrench.

Referring to FIGS. 3, 4, and 5, the inner perimeter 30 and the outer perimeter 32 of the second set members 24 is irregularly and asymmetrically shaped, the inner perimeter of the second set 30 closely engaging the center member 22 when both are positioned within the chamber 16. Likewise, as shown in FIG. 5, the inner perimeter 34 and outer perimeter 36 of the third set of members 26 are also irregularly and asymmetrically shaped, the inner perimeter 34 of the third set 26 closely engaging the outer perimeter 32 of the second set 24 when both sets are positioned within the chamber 16. The generally concentric, irregular set configuration of the members provides the socket wrench 10 with structural advantages similar to that of integral sockets, while, unlike such integral sockets, maintaining the advantage of a high degree of compatibility with various shapes and sizes of fastener components. This configuration, in cooperation with the shapes and nonuniform cross-sectional areas of the members 20, also provides the capability to engage fastener components without the need to center such components relative to the chamber 16.

In this embodiment, the second and third sets, 24 and 26, respectively, each comprise six slidable members, such members in this embodiment having a generally uniform, chevron shape. It is to be understood that the number of members 20 in each set is not critical to the operation of this embodiment. The chevron shape of the members 20, in combination with the organization of the slidable members 20 into three irregular sets as described, provides a plurality of edges generally indicated at 28, adapted to securely grip fastener components.

The individual slidable members 20 have a uniform longitudinal length, and a generally nonuniform cross-sectional area. Preferably, the smallest cross-sectional area-to-length ratio of the members 20 is about one (1) to fifteen (15). This ratio is large relative to the ratios taught in the prior art, and provides an advantage over prior art slidable pins and rods having low ratios in that the members 20 resist deformation and fracture when high torque values are applied to them during use of the wrench 10. Accordingly, larger ratios will significantly improve the deformability and fracture characteristics of the members.

The members 20 are suspended within the chamber 16 in a slidable relationship with respect to one another and with respect to the chamber. In particular, referring to FIGS. 2 and 12, the suspension means of this embodiment comprises outwardly extending flanges 38 on the second end of the center member 22 for engagement with inset shoulders 40 on the second ends of the members of the second set 24, outwardly extending flanges 38 on the second ends of the members of the second set 24 for engagement with inset shoulders 40 on the second end of members of the third set 26, and outwardly extending flanges 38 on the second end of the members of the third set 26 for engagement with an inset shoulder 40 on the chamber 16. The members of the third set 26 are thereby retained within the chamber 16 by the engagement of their flanges 38 with the inset shoulder 40 of the chamber. The members of the second set 24 are retained by a similar engagement with the members of the third set 26, and the center member 22 is retained by a similar engagement with the members of the second set 26. The flange and shoulder configuration of the suspension system of this embodiment is further arranged such that the flange 38 of each second set member 24 engages only with the inset shoulder 40 of one third set member 26, and vice versa, whereas the flanges 38 of the center member 22 engage all of the inset shoulders 40 of the second set members 24.

Another result of the suspension system in this embodiment is that when a third set member 26 is displaced toward the second end of the chamber by a fastener component, the inset shoulder 40 of that member forces the center member 22 and the second set member that is positioned between the center member and the third set member to slide in unison toward the second end of the chamber. It is understood that other suspension means may be employed to enable the center member 22 or the second set members 24 to avoid displacement when all or some of the other members 20 are displaced.

Figure 7:
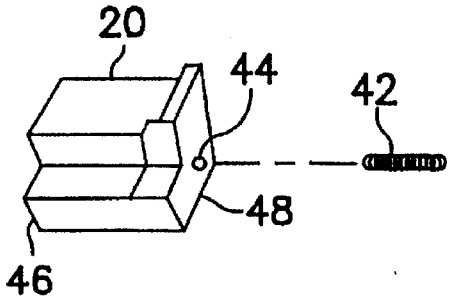
FIG. 7 is a perspective view of a representative slidable member of the instant embodiment.
Figure 8:
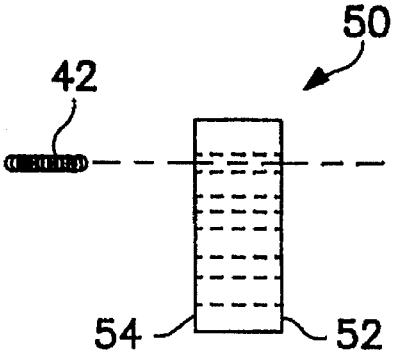
FIGS. 8, 9 and 10, 11 are orthographic views of the insert and backing plate, respectively.
Figure 9:
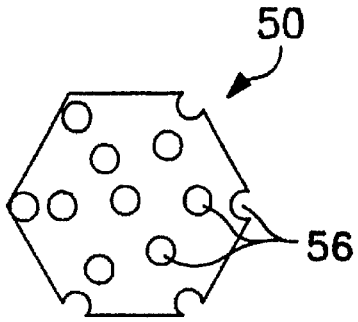

Referring to FIG. 7, each of the slidable members 20 is biased in a nominal position by individual longitudinal compression springs 42, such that the first ends 46 of the members 20 are flush with the first end 18 of the chamber 16. The first end of each spring is received in a bore 44 in the second end 48 of each slidable member 20. Referring now to FIGS. 8 and 9, an insert 50 having a first end 52 and a second end 54, and a plurality of bores 56 extending therethrough, is positioned within the chamber 16 between the second end 19 of the chamber 16 and the springs 42, and the second end of each spring is received at the first end of the insert 52, in one of the bores 56 of the insert 50. The insert 50 has a longitudinal thickness preferably equivalent to approximately one-third (⅓) the length of the springs.

Figure 10:
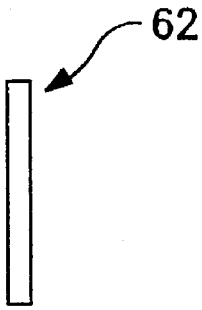
Figure 11:
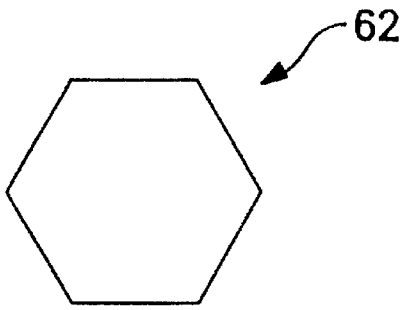

As can be seen in FIG. 6, a plug 58 is press fitted into the second end 19 of the chamber 16 to close the chamber, the plug 58 comprising an integral body having a hexagonal cross section for cooperation with the hexagonal chamber 16, and having a bore 60 therethrough to accept a mounting lug 15. The plug 58 is preferably made of steel or another suitable material capable of transferring loads from the drive tool 12 to the socket 10. Referring now to FIGS. 10 and 11, to prevent the springs 42 from escaping through the bores 56 of the insert 50 and the plug 58, a thin backing plate 62 is positioned between the insert 50 and the plug 58, the backing plate 62 comprising an integral body having a hexagonal cross section for cooperation with the hexagonal chamber 16.

Figure 12:
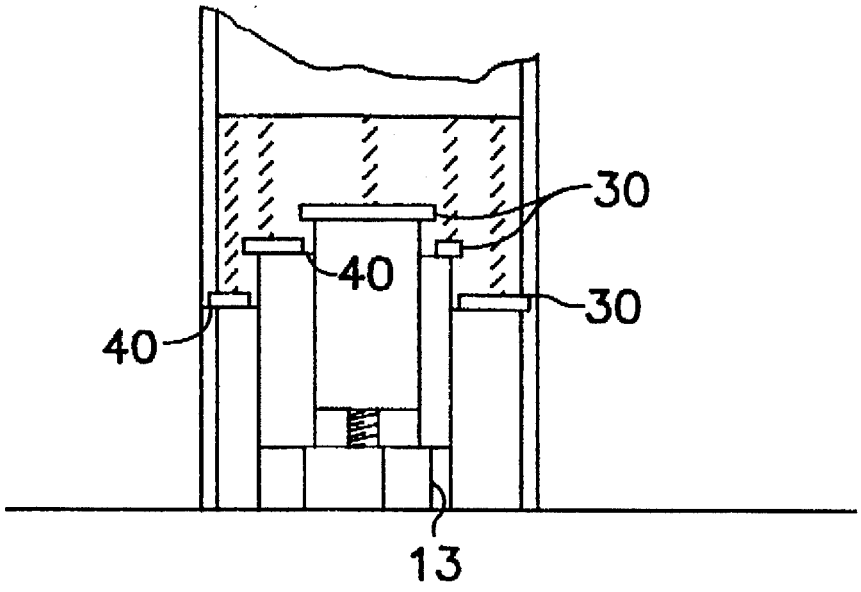
FIG. 12 is an enlarged cross-sectional view showing the manner in which the slidable members are displaced to accommodate a hex head bolt.

Referring to FIG. 12, in use, the first ends 46 of the slidable members 20 are placed into contact with a fastener component generally indicated at 13, and the socket wrench 10 pressed upon the component 13 so that the contacted members 20 are displaced. The members that are not displaced surround the fastener component 13, the edges 28 of the members 20 gripping the component 13 so that it may be turned. All members are biased in their positions by the compression springs 42. The socket driver 12 slidably engages the bore 60 of the plug 62, and the socket housing 14 is rotated by means of the socket driver 12 in the conventional manner. When the socket wrench 10 is removed from engagement with the fastener component 13, the slidable members 20 are returned to their nominal positions by the compression springs 42.

It can therefore be seen that the instant invention provides a unique and novel embodiment of a universal socket wrench. The chevron shape of the slidable members provides an inherently structurally strong cross-sectional shape to withstand the application to the wrench of large amounts of torque. Additionally, the relatively large cross-sectional area-to-length ratio of the slidable members provides the wrench with a significantly enhanced ability to apply such torques. Furthermore, the generally nonuniform cross-sectional areas of the members, and their arrangement in generally concentric sets, provides a wrench with an enhanced ability to engage a wide variety of fastener head sizes and shapes. When coupled with the chevron shape of the members, these features also provide a plurality of edges for an enhanced fastener component gripping ability. The suspension and biasing systems of the instant socket wrench are greatly simplified, allowing simplified assembly and inexpensive manufacture. For these reasons, the instant invention is believed to represent a significant advance in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A universal socket wrench comprising:

a housing enclosing a longitudinal chamber having an open first end, and a second end;

a plurality of members, at least one of said members being of nonuniform shape and size, and said plurality of members having first and second ends and being longitudinally oriented in said chamber in a first position in which said first ends of said members are proximally located with said first end of said chamber for engagement with a fastener component;

said members having a second position to which said members will be forced when said first ends of said members contact said fastener component;

means, within said chamber, for suspending said members in longitudinal slidable relationship to each other;

means for returning said members to their first positions once contact with said fastener component is terminated.

2. The wrench of claim 1, wherein said members have a chevron shape.

3. The wrench of claim 1, wherein said members have a cross-sectional area-to-length ratio of at least about one to twenty.

4. The wrench of claim 1, wherein said members are arranged in a plurality of sets surrounding a center member, each of said sets having inner and outer perimeters.

5. The wrench of claim 4, wherein said inner perimeters of said sets are asymmetrical in shape.

6. The wrench of claim 1, said means for suspending said members in longitudinal slidable relationship to each other comprising outwardly extending flanges on said second ends of said members, and inset shoulders provided on said chamber, said flanges engaging said inset shoulders on said chamber.

7. The wrench of claim 1, said means for returning said members to their first positions once contact with said fastener component is terminated comprising a plurality of springs having first ends for engagement of said second ends of said members, and having second ends, and further comprising an insert having a plurality of bores therethrough for seating said second ends of said springs.

8. A universal socket wrench comprising:

a housing enclosing a longitudinal chamber having an open first end, and a second end;

a plurality of chevron-shaped members, at least one of said members being of nonuniform size, and said plurality of members having first and second ends and being longitudinally oriented in said chamber in a first position in which said first ends of said members are proximally located with said first end of said chamber for engagement with a fastener component;

said plurality of members being arranged in a plurality of sets surrounding a center member, each of said sets having inner and outer perimeters, said inner perimeters having asymmetrical shapes;

said plurality of members further having a second position to which said members will be forced when said first ends of said members contact said fastener component;

means, within said chamber, for suspending said members in longitudinal slidable relationship to each other;

means for returning said members to their first positions once contact with said fastener component is terminated.

9. The wrench of claim 8, wherein said members have a cross-sectional area-to-length ratio of at least about one to twenty.

10. The wrench of claim 8, said means for suspending said members in longitudinal slidable relationship to each other comprising outwardly extending flanges on said second ends of said members, and inset shoulders provided on said chamber, said flanges engaging said inset shoulders on said chamber.

11. The wrench of claim 8, said means for returning said members to their first positions once contact with said fastener component is terminated comprising a plurality of springs having first ends for engagement of said second ends of said members, and having second ends, and further comprising an insert having a plurality of bores therethrough for seating said second ends of said springs.

12. A universal socket wrench comprising:

a housing enclosing a longitudinal chamber having an open first end, and a second end;

a plurality of chevron-shaped members, at least one of said members being of nonuniform size, and said plurality of members having first and second ends and being longitudinally oriented in said chamber in a first position in which said first ends of said members are proximally located with said first end of said chamber for engagement with a fastener component;

said plurality of members having a cross-sectional area-to-length ratio of at least about one to twenty, and said members being arranged in a plurality of sets surrounding a center member, each of said sets having inner and outer perimeters, said inner perimeters having an asymmetrical shape;

said plurality of members further having a second position to which said members will be forced when said first ends of said members contact said fastener component;

means within said chamber for suspending said members in longitudinal slidable relationship to each other comprising outwardly extending flanges on said second ends of said members, inset shoulders provided on said chamber, said flanges engaging said inset shoulders on said chamber;

means for returning said members to their first positions once contact with said fastener component is terminated comprising a plurality of springs having first ends for engagement of said second ends of said members, and having second ends, and further comprising an insert having a plurality of bores therethrough for seating said second ends of said springs.

* * * * *